US006672269B1

(12) United States Patent
Bonde et al.

(10) Patent No.: US 6,672,269 B1
(45) Date of Patent: Jan. 6, 2004

(54) AUTOMATIC COMPRESSION RELEASE MECHANISM

(75) Inventors: Kevin G. Bonde, Kiel, WI (US); Robert W. Richards, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/199,165

(22) Filed: Jul. 18, 2002

(51) Int. Cl.[7] ..... F01L 13/08
(52) U.S. Cl. ..... 123/182.1
(58) Field of Search ..... 123/182.1; 24/563, 24/569

(56) References Cited

U.S. PATENT DOCUMENTS

| | | | | |
|---|---|---|---|---|
| 3,362,390 | A | * 1/1968 | Esty | 123/182.1 |
| 4,193,310 | A | 3/1980 | Boyer et al. | |
| 4,527,518 | A | 7/1985 | Osaki et al. | |
| 4,590,905 | A | 5/1986 | Matsuki et al. | |
| 4,615,312 | A | 10/1986 | Tsumiyama | |
| 4,615,313 | A | 10/1986 | Tsumiyama | |
| 4,617,882 | A | 10/1986 | Matsumoto | |
| 4,651,687 | A | 3/1987 | Yamashita et al. | |
| 4,672,930 | A | * 6/1987 | Sumi | 123/182.1 |
| 4,703,723 | A | 11/1987 | Tamba et al. | |
| 4,790,271 | A | 12/1988 | Onda | |
| 4,805,565 | A | 2/1989 | Sato et al. | |
| 5,065,720 | A | 11/1991 | Nishiyama et al. | |
| 5,085,184 | A | 2/1992 | Yamada et al. | |
| 5,653,199 | A | 8/1997 | Ishiuchi et al. | |
| 5,722,295 | A | 3/1998 | Sakai et al. | |
| 5,943,992 | A | 8/1999 | Kojima et al. | |
| 6,250,271 | B1 | 6/2001 | Ikuma et al. | |
| 6,269,786 | B1 | * 8/2001 | Snyder et al. | 123/182.1 |
| 6,305,242 | B1 | 10/2001 | Smith et al. | |
| 6,543,403 | B2 | 4/2003 | Kawamoto | |
| 2001/0037785 | A1 | * 11/2001 | Gracyalny et al. | 123/185.14 |

* cited by examiner

*Primary Examiner*—Henry C. Yuen
*Assistant Examiner*—Arnold Castro
(74) *Attorney, Agent, or Firm*—Quarles & Brady LLP

(57) ABSTRACT

An automatic compression release mechanism for implementation in an internal combustion engine, and a method of assembling such a mechanism, are disclosed. The mechanism includes a camshaft assembly including a cam gear, a cam lobe with a notch positioned along a first side of the gear, a tube passing through the gear and aligned with the notch, and a support on a second side of the gear. The mechanism additionally includes an arm including a weight and shaft coupled to one another, where an end of the shaft includes a recess, and where the shaft is rotatably positioned within the tube and the end of the shaft with the recess extends into the notch. The mechanism further includes a retaining member positioned onto the support so that the weight is positioned between the retaining member and the tube and retained with respect to the gear.

20 Claims, 5 Drawing Sheets

AUTOMATIC COMPRESSION RELEASE MECHANISM

FIELD OF THE INVENTION

The present invention relates to internal combustion engines and, more particularly, to automatic compression release mechanisms employed in internal combustion engines.

BACKGROUND OF THE INVENTION

Automatic compression release mechanisms are employed in internal combustion engines to provide for improved engine performance at a variety of engine speeds. Such mechanisms typically include a component, actuated based upon engine speed, that varies an exterior surface characteristic of a cam lobe along which a push rod governing an exhaust valve of the engine rides. Specifically, when engine speeds are low, such as during the starting of the engine, a protrusion is created on the cam lobe such that the exhaust valve tends to open slightly during the compression stroke of the engine, which facilitates the starting of the engine. However, when engine speeds are higher, such as during normal operation of the engine, the protrusion is eliminated such that the exhaust valve remains closed during the compression stroke of the engine to maximize engine power.

Automatic compression release mechanisms of this type often employ a weight that is rotatably affixed to a portion of the camshaft such as a cam gear. As the rotational speed of the camshaft increases, centrifugal forces acting on the weight tend to cause the weight to rotate outwards (away from the camshaft axis). However, the weight is typically biased by a spring towards the camshaft so that, while the engine is at low speeds, the weight is rotated inward toward the camshaft. Because the movement of the weight is dependent upon the rotational speed of the camshaft, the movement of the weight can be used to govern components associated with the cam lobe to produce the desired speed-dependent variation in cam lobe shape. Commonly these components include a shaft having a recessed side and an unrecessed side, which is mounted along the exterior surface of the cam lobe. When the weight is rotated inwards, the unrecessed side of the shaft extends outward beyond the exterior surface of the cam lobe producing a protrusion, and when the weight is rotated outwards, the recessed side of the shaft faces outward and the protrusion on the cam lobe is largely or entirely eliminated.

In many engines, it is desirable to employ an automatic compression release mechanism having as few components as possible, in order to simplify and consequently reduce the costs of the mechanism. This can be achieved to some extent by integrally forming as a single piece the weight and the shaft having the recessed and unrecessed sides, such that rotation of the weight directly causes rotation of the shaft. For similar cost-related reasons, it often is desirable for engines to employ simply-formed and inexpensive components throughout the cam shaft assembly. For example, the cam gear can be molded out of plastic or diecast as a single piece. Also, the cam lobe can be integrally formed as part of the cam gear, or at least fixedly attached onto, the cam gear.

However, the desire for simplified cam shaft assembly components can conflict with the desire for simplified automatic compression release mechanisms having fewer components. In particular, given close proximity of the cam gear and cam lobe, the weight and shaft of the automatic compression release mechanism cannot be effectively mounted on the side of the cam gear facing the cam lobe. At the same time, if the weight and shaft are mounted on the other side of the cam gear opposite the cam lobe, the shaft must then extend through the cam gear and onto the cam lobe to provide the desired operation. Retention of the weight and shaft on the cam gear then becomes problematic. In particular, clasps or other simple components that could be attached at the end of the shaft to keep the shaft in place relative to the cam gear cannot effectively be employed unless the shaft extends beyond the cam lobe, which renders the shaft excessively long and fragile and increases manufacturing costs (particularly where it is desired to manufacture the shaft using powdered metal technologies).

It therefore would be desirable if a new automatic compression release mechanism were developed that employed few and inexpensive components and was capable of being implemented on simple camshaft components such as an integrally-formed cam gear and cam lobe. It further would be desirable if the new automatic compression release mechanism employed an integrally-formed weight and shaft that was small and inexpensive to manufacture, and at the same time was easily mounted on and retained with respect to the cam gear.

SUMMARY OF THE INVENTION

The present inventors have discovered a simplified automatic compression release mechanism that can be implemented on a camshaft having a cam gear and cam lobe attached together (or integrally formed), and that requires few, inexpensive parts, is robust and is easy to assemble. The mechanism includes an arm having an integrally formed weight and shaft. The arm is mounted on the cam gear by inserting the shaft into a tube extending through the cam gear so that the shaft extends past the gear and along the surface of the adjacent cam lobe. The weight is then locked into place in the axial direction (along an axis of the tube) by way of a retaining mechanism existing on the side of the cam gear on which the weight is located. In one embodiment, the retaining mechanism includes a pillar extending outward from (and formed integrally with) the cam gear, and a retaining disk that is fitted onto the pillar. A lip of the retaining disk extends over the weight and thereby retains the weight and shaft in position with respect to the cam gear. Consequently, it is not necessary that the shaft of the arm be excessively long to extend beyond the cam lobe in order for the shaft and weight to be retained.

In particular, the present invention relates an automatic compression release mechanism for implementation in an internal combustion engine including a cam shaft assembly having a cam gear, a cam lobe positioned along a first side of the cam gear, the cam lobe including a notch, a hollow tube passing from the first side of the cam gear to a second side of the cam gear and substantially aligned with the notch, and a support extending from the second side of the cam gear proximate the hollow tube. The automatic compression release mechanism further includes an arm including a weight and a shaft, where a first end of the shaft is coupled to a near end of the weight and a second end of the shaft includes a recessed portion, where the shaft is rotatably positioned within the hollow tube so that the weight is positioned along the second side of the cam gear and the second end of the shaft protrudes out of the hollow tube beyond the first side of the cam gear and into the notch. The automatic compression release mechanism additionally includes a retaining member positioned onto the support so that the weight is positioned in between the retaining member and the hollow tube and retained with respect to the cam gear.

The present invention further relates to an automatic compression release mechanism including a cam lobe, a cam gear having a first side and a second side, the cam lobe abutting the first side, and an arm including a weighted portion positioned proximate the second side of the cam gear and a shaft coupled to the weighted portion and extending through a tube from the second side of the cam gear to and beyond the first side of the cam gear and into a notch within the cam lobe. The automatic compression release mechanism additionally includes means for retaining the arm in a substantially constant position with respect to an axis of the tube.

The present invention additionally relates to a method of assembling an automatic compression release mechanism on an internal combustion engine. The method includes providing a camshaft assembly including a cam lobe and a cam gear having a first side and a second side, where the first side of the cam gear is adjacent to the cam lobe, where the cam lobe includes a notch along its exterior surface, where the cam gear includes a hollow tube that extends through the cam gear and is aligned with the notch along the first side of the cam gear, and where the cam gear further includes a pillar protruding from the second side. The method further includes providing an arm having a weight with a first side and a second side and a shaft having a first end and a second end, where the first end of the shaft is attached to the weight, and where the second end of the shaft includes a recessed portion. The method also includes inserting the shaft of the arm through the hollow tube so that the second end of the shaft including the recessed portion is positioned at least partly within the notch, and so that the first side of the weight is proximate the hollow tube. The method additionally includes coupling a retaining member to the pillar so that at least a portion of the retaining member extends over the second side of the weight and prevents excessive movement of the shaft out of the hollow tube and excessive movement of the weight away from the second side of the cam gear.

DETAILED DESCRIPTION OF THE PREFERRED EMBODIMENT

Figure 1:
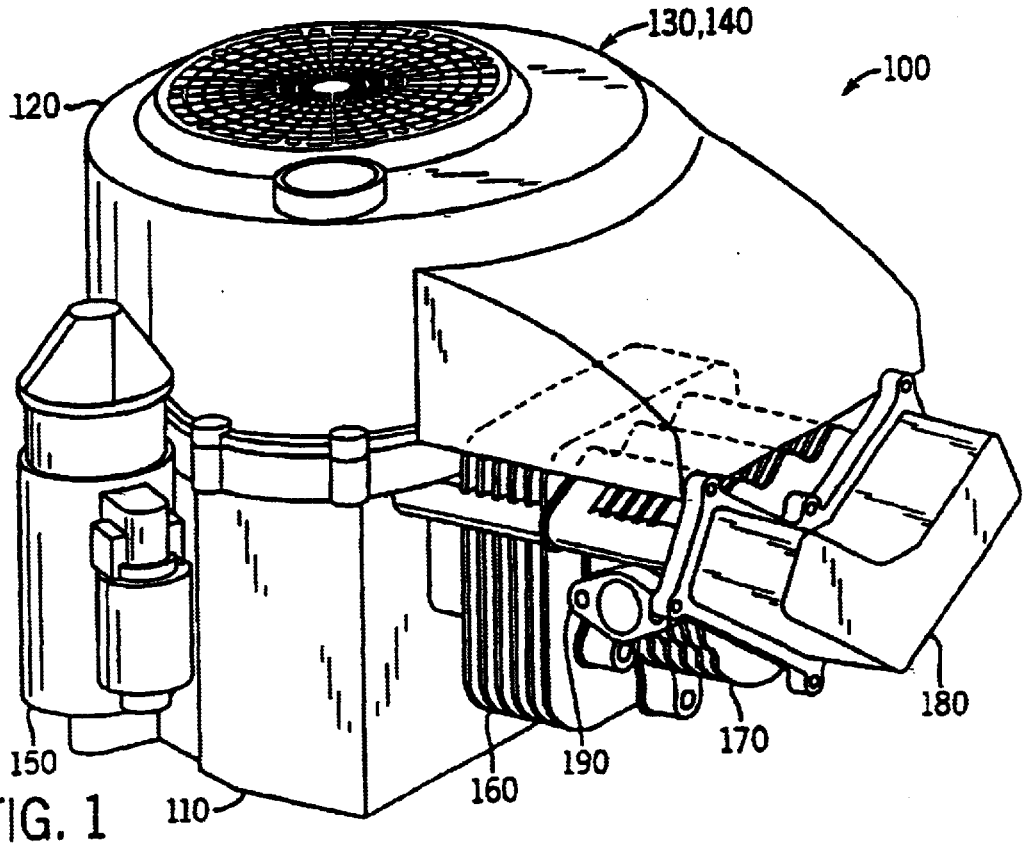
FIG. 1 is a first perspective view of a single cylinder engine, taken from a side of the engine on which are located a starter and cylinder head.
Figure 2:
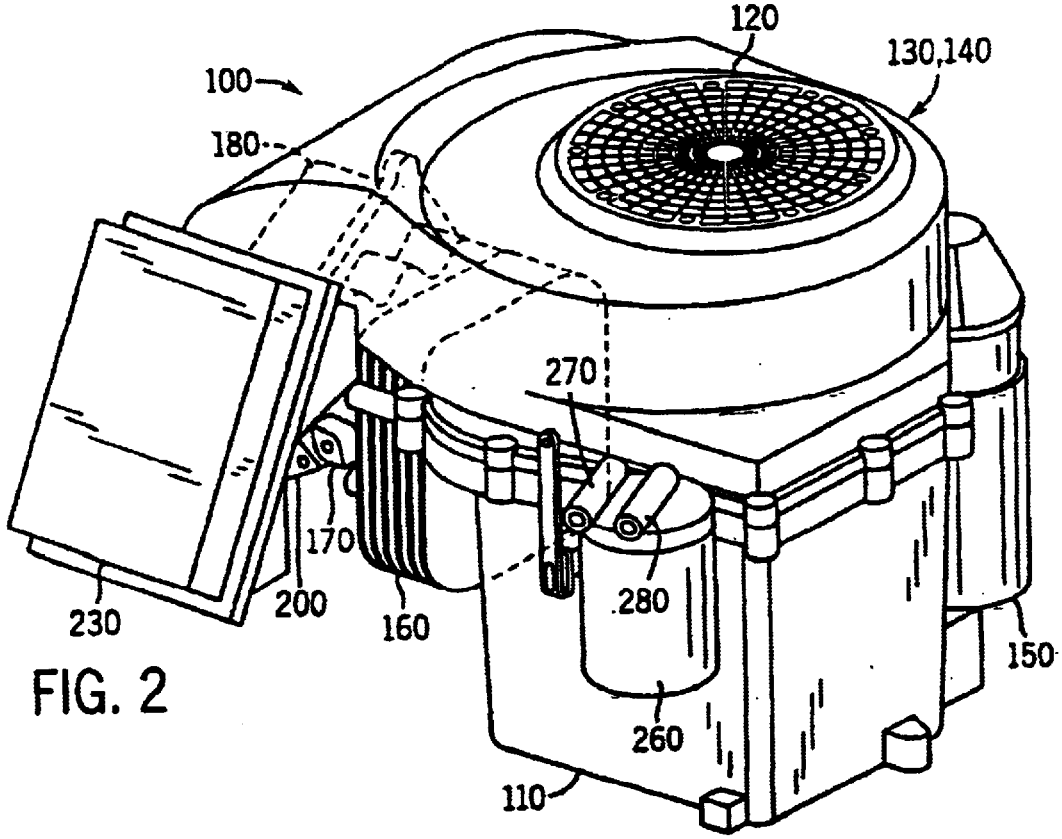
FIG. 2 is a second perspective view of the single cylinder engine of FIG. 1, taken from a side of the engine on which are located an air cleaner and oil filter.

Referring to FIGS. 1 and 2, a new single cylinder, 4-stroke, internal combustion engine 100 designed by Kohler Co. of Kohler, Wis. includes a crankcase 110 and a blower housing 120, inside of which are a fan 130 and a flywheel 140. The engine 100 further includes a starter 150, a cylinder 160, a cylinder head 170, and a rocker arm cover 180. Attached to the cylinder head 170 are an air exhaust port 190 shown in FIG. 1 and an air intake port 200 shown in FIG. 2. As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft. The rotation of the fan 130 cools the engine, and the rotation of the flywheel 140, causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder through the cylinder head and then out of the air exhaust port 190. The inflow and outflow of air into and out of the cylinder 160 by way of the cylinder head 170 is governed by an input (intake) valve 240 and an output (exhaust) valve 250, respectively (see FIG. 8). Also as shown in FIG. 2, the engine 100 includes an oil filter 260 through which the oil of the engine 100 is passed and filtered. Specifically, the oil filter 260 is coupled to the crankcase 110 by way of incoming and outgoing lines 270, 280, respectively, whereby pressurized oil is provided into the oil filter and then is returned from the oil filter to the crankcase.

Figure 3:
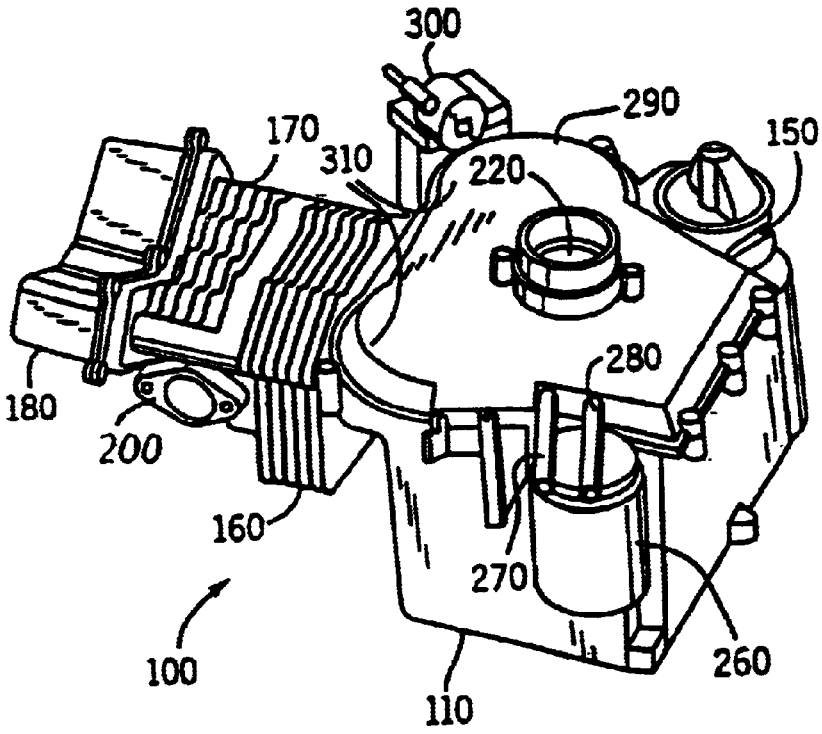
FIG. 3 is a third perspective view of the single cylinder engine of FIG. 1, in which certain parts of the engine have been removed to reveal additional internal parts of the engine.
Figure 4:
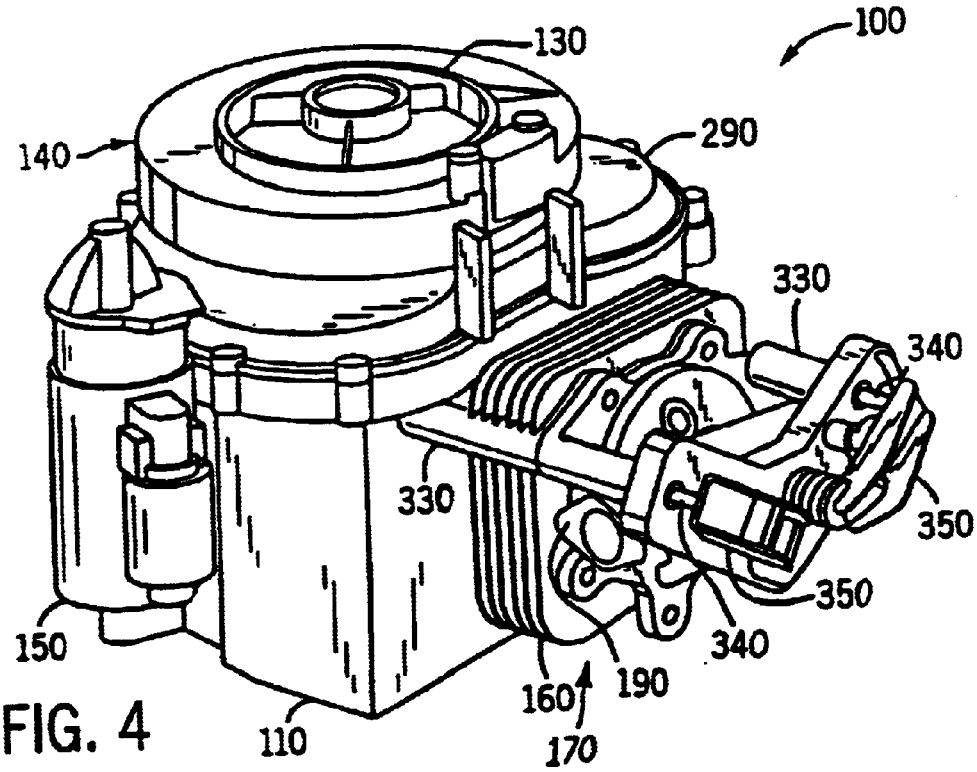
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose a top 290 of the crankcase 110. With respect to FIG. 3, in which both the fan 130 and the flywheel 140 are also removed, a coil 300 is shown that generates an electric current based upon rotation of the fan 130 and/or the flywheel 140, which together operate as a magneto. Additionally, the top 290 of the crankcase 110 is shown to have a pair of lobes 310 that cover a pair of gears 320 (see FIGS. 5 and 7–8). With respect to FIG. 4, the fan 130 and the flywheel 140 are shown above the top 290 of the crankcase 110. Additionally, FIG. 4 shows the engine 100 without the cylinder head 170 and without the rocker arm cover 180, to more clearly reveal a pair of tubes 330 through which extend a pair of respective push rods 340. The push rods 340 extend between a pair of respective rocker arms 350 and a pair of cams 360 (see FIG. 8) within the crankcase 110, as discussed further below.

Figure 5:
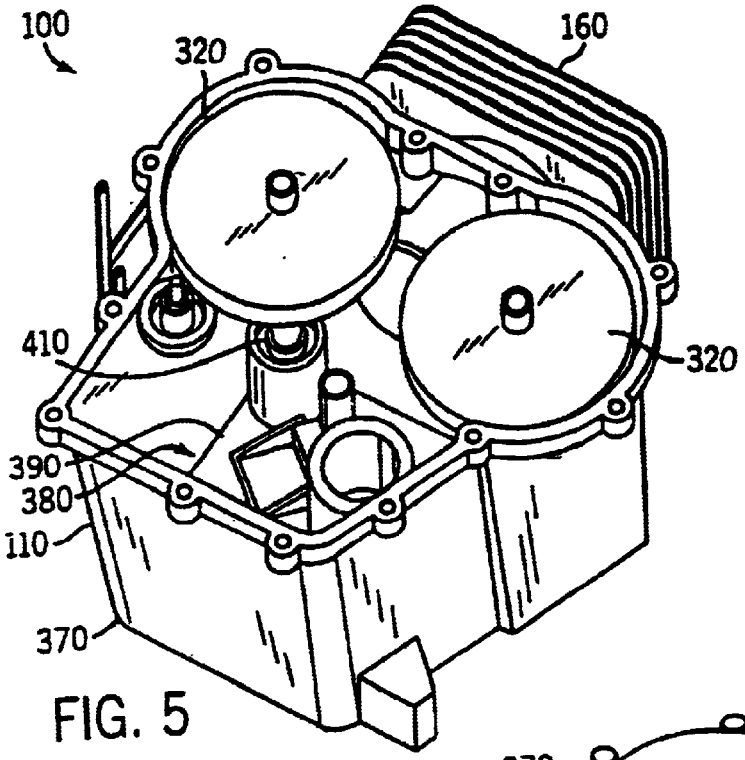
FIG. 5 is fifth perspective view of portions of the single cylinder engine of FIG. 1, in which a top of the crankcase has been removed to reveal an interior of the crankcase.
Figure 6:
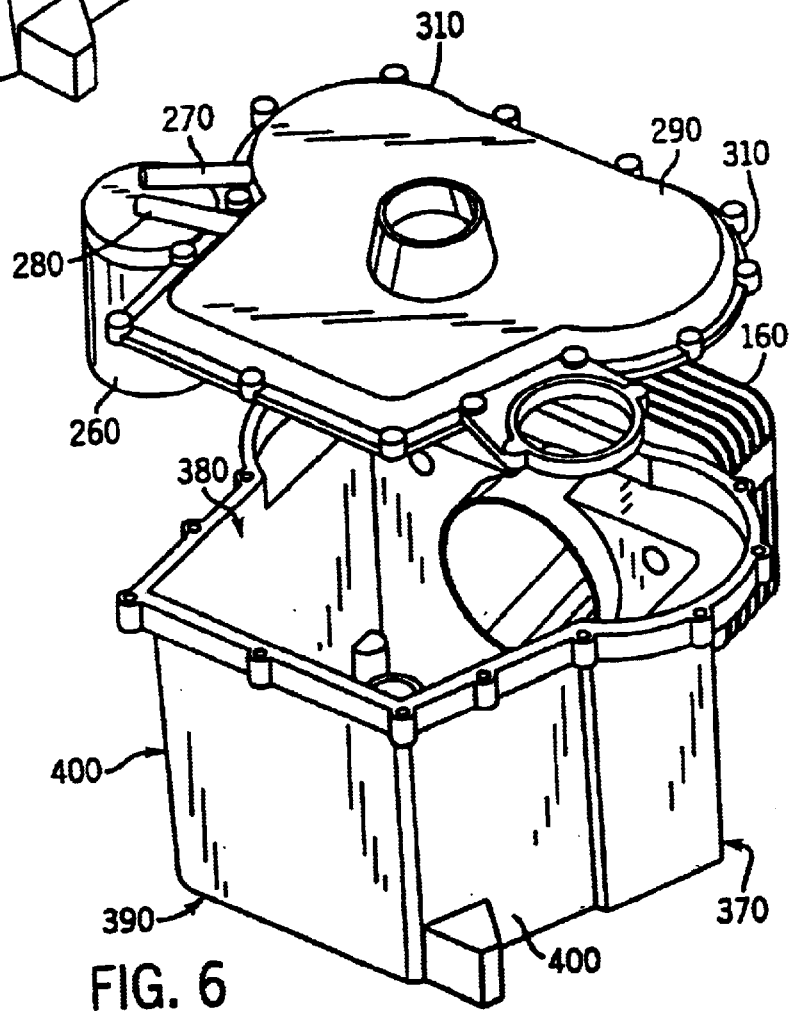
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the top 290 of the crankcase 110 removed from a bottom 370 of the crankcase 110 to reveal an interior 380 of the crankcase. Additionally in FIGS. 5 and 6, the engine 100 is shown in cut-away to exclude portions of the engine that extend beyond the cylinder 160 such as the cylinder head 170. With respect to FIG. 6, the top 290 of the crankcase 110 is shown above the bottom 370 of the crankcase in an exploded view. In this embodiment, the bottom 370 includes not only a floor 390 of the crankcase, but also all four side walls 400 of the crankcase, while the top 290 only acts as the roof of the crankcase. The top 290 and bottom 370 are manufactured as two separate pieces such that, in order to open the crankcase 110, one physically removes the top from the bottom. Also, as shown in FIG. 5, the pair of gears 320 within the crankcase 110 are integrally formed as part of, or at least supported by, respective camshafts 410, which in turn are supported by the bottom 370 of the crankcase 110.

Figure 7:
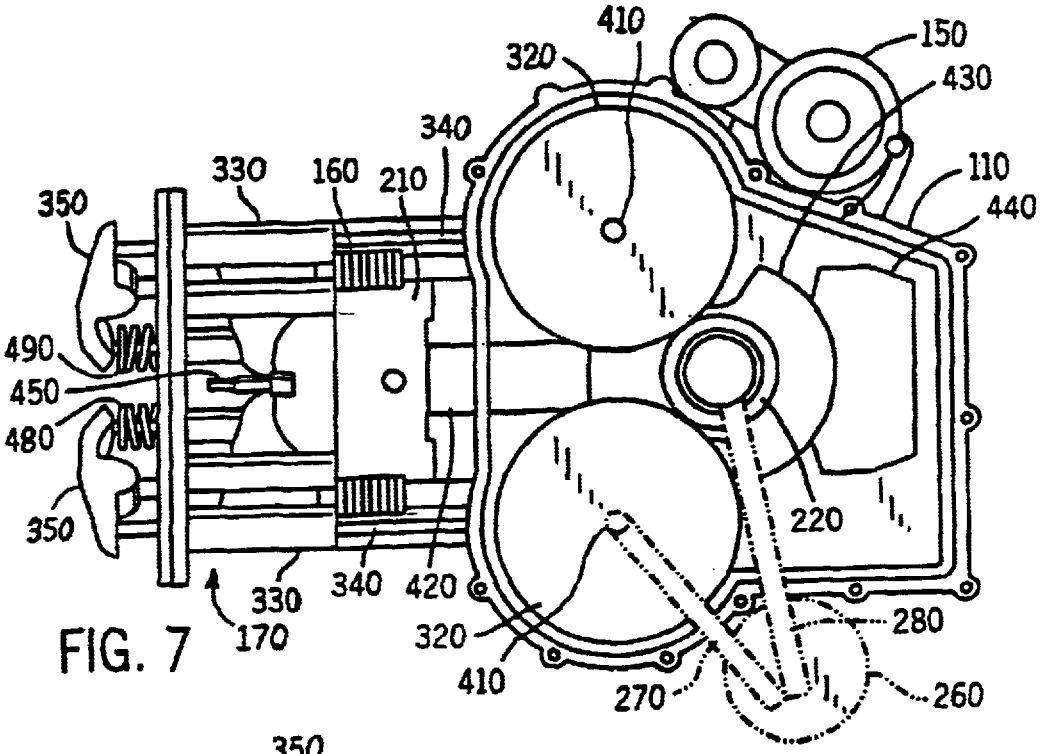
FIG. 7 is a top view of the single cylinder engine of FIG. 1, showing internal components of the engine.

Referring to FIG. 7, a top view of the engine 100 is provided in which additional internal components of the engine are shown. In particular, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320, and thus communicates rotational motion to the gears. In the present embodiment, the camshafts 410 upon which the gears 320 are supported are capable of communicating oil from the floor 390 of the crankcase 110 (see FIG. 5) upward to the gears 320. The incoming line 270 to the oil filter 260 is coupled to one of the camshafts 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Figure 8:
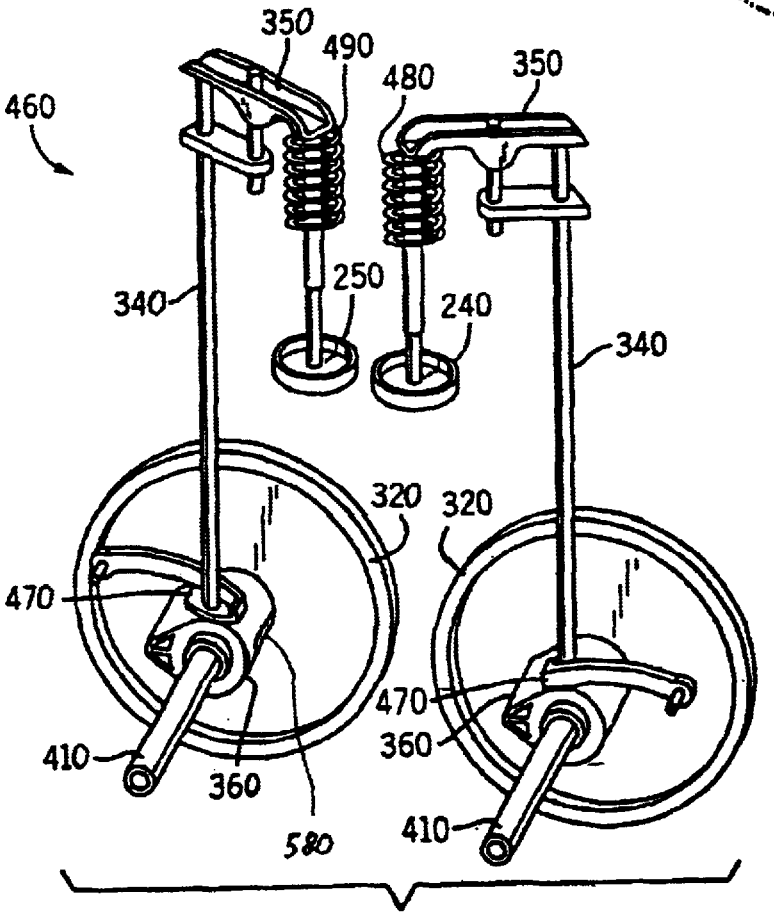
FIG. 8 is a perspective view of components of a valve train of the single cylinder engine of FIG. 1.

Further referring to FIG. 7, and additionally to FIG. 8, elements of a valve train 460 of the engine 100 are shown. The valve train 460 includes the gears 320 resting upon the camshafts 410 and also includes the cam lobes 360 underneath the gears, respectively. Additionally, respective cam follower arms 470 that are rotatably mounted to the crankcase 110 extend to rest upon the respective cam lobes 360. The respective push rods 340 in turn rest upon the respective cam follower arms 470. As the cam lobes 360 rotate, the push rods 340 are temporarily forced outward away from the crankcase 110 by the cam follower arms 470. This causes the rocker arms 350 to rock or rotate, and consequently causes the respective valves 240 and 250 to open toward the crankcase 110. As the cam lobes 360 continue to rotate, however, the push rods 340 are allowed by the cam follower arms 470 to return inward to their original positions. A pair of springs 480,490 positioned between the cylinder head 170 and the rocker arms 350 provide force tending to rock the rocker arms in directions tending to close the valves 240, 250, respectively. Further as a result of this forcing action of the springs 480,490 upon the rocker arms 350, the push rods 340 are forced back to their original positions.

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cam lobes 360 could be located above the gears 320 rather than underneath the gears.

Figure 9:
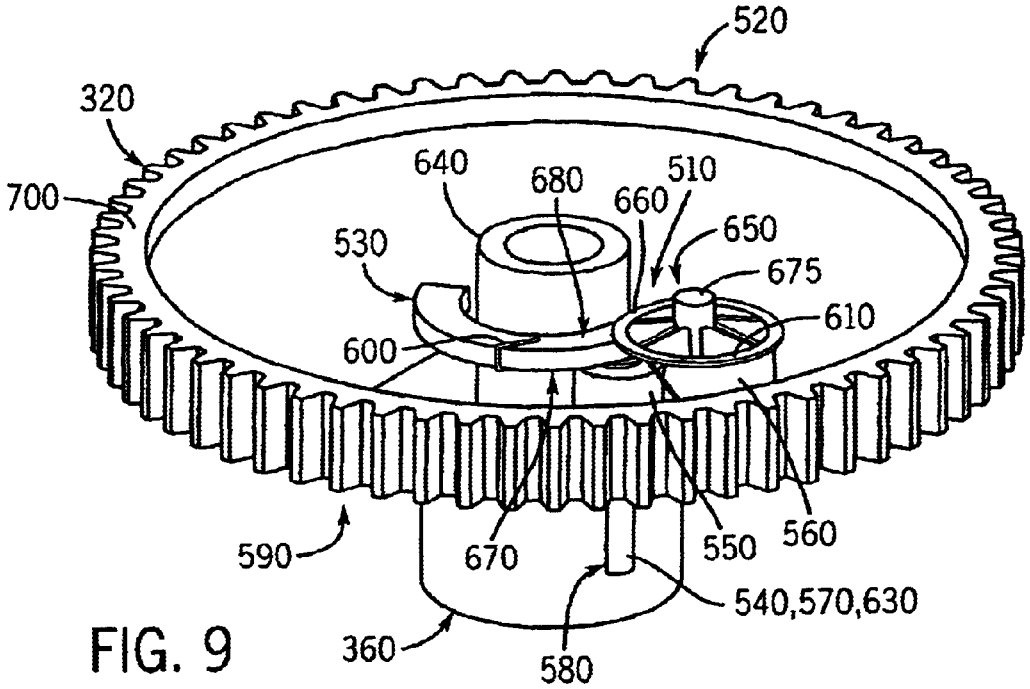
FIG. 9 is a perspective view of a camshaft, cam gear and automatic compression release (ACR) mechanism implemented in the engine of FIG. 1.
Figure 10:
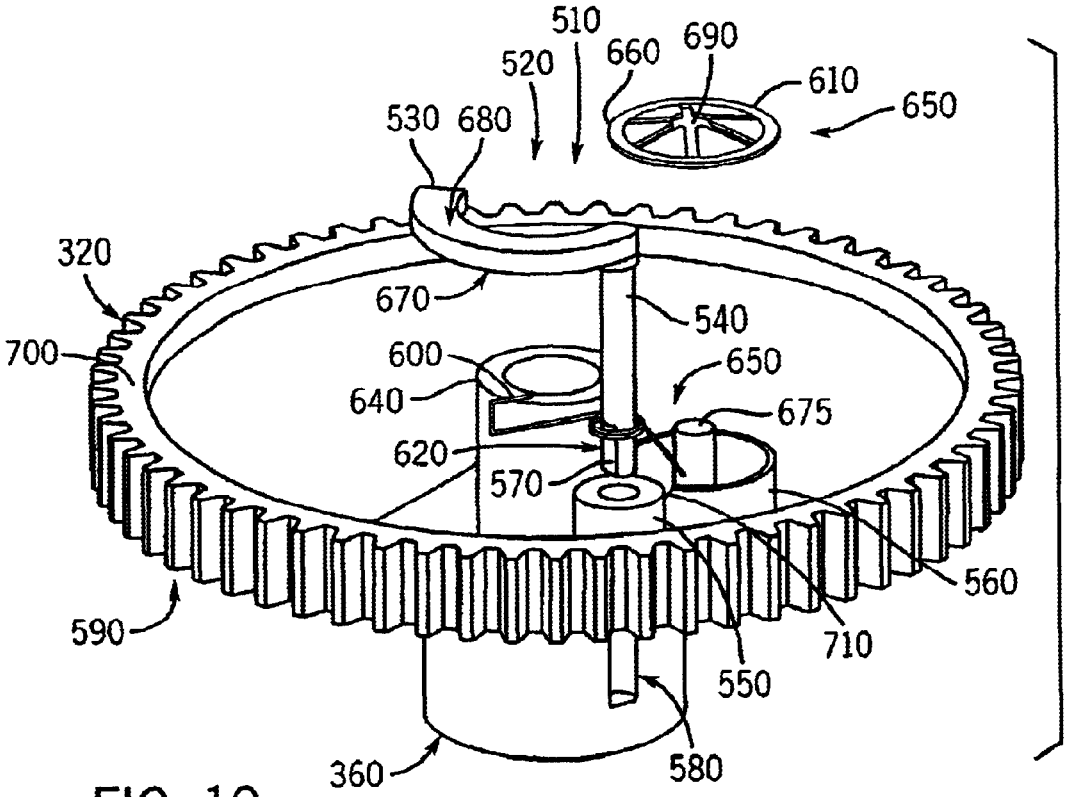
FIG. 10 is a perspective view of the camshaft, cam gear and ACR mechanism of FIG. 9, with the ACR mechanism exploded from the cam gear.

As shown in FIGS. 9 and 10, an automatic compression release (ACR) mechanism is incorporated as part of the cam gear 320/cam shaft 410 associated with the exhaust valve 250. The ACR mechanism includes an arm 510, which includes an arc-shaped weight 530 and a support shaft 540 that are integrally formed with one another. In one embodiment, the arm 510 is formed through the use of powdered metal, although in alternate embodiments it could be molded from plastic or other materials, or diecast. The arm 510 is assembled onto the cam gear 320 by extending the support shaft 540 into and through a hollow tube 550 formed as part of the cam gear 320. The hollow tube 550 extends from a second side 520 of the cam gear 320 through the gear and out a first side 590 of the gear. In the present embodiment, the cam gear 320 is adjacent and attached to, or integrally formed with, the cam lobe 360. For example, the cam gear 320 and cam lobe 360 can be integrally formed from a single piece of plastic, or the cam lobe can be metallic and be fixed onto the gear.

Upon assembly, a first side 670 of the arc-shaped weight 530 abuts the hollow tube 550 (or a portion of the second side 520 of the cam gear 320). Also, the shaft 540 further extends outward from the tube 550 beyond the first side 590 of the cam gear 320 and protrudes along the exterior surface of the cam lobe 360. In particular, a far end 570 of the support shaft 540 extends at least partly into a concave groove or notch 580 in the surface of the cam lobe 360 (see also FIG. 8). The support shaft 540, which throughout most of its length is cylindrical, at the far end 570 is missing a segment such that the support shaft has a recessed surface 620 at the far end (see FIG. 10 in particular). Consequently, the shaft 540 at the far end 570 has a cross-sectional shape that is approximately D-shaped.

As shown in FIG. 9, the arc-shaped weight 530 is biased by a spring 600 toward a tube/shaft 640 extending off of the second side 520 of the cam gear 320 (which in FIGS. 9–10 is shown to have an overall concave shape). Although in the present embodiment, the tube 640 is shown to be integrally formed with the cam gear 320, in alternate embodiments the tube can be a separate component that is fixed in relation to the cam gear, and/or is part of the cam shaft 410. The mass of the arc-shaped weight 530 and the force of the spring 600 are selected so that, as the rotational speed of the cam gear 320 increases, the arc-shaped weight 530 swings outward away from the tube 640 about the support shaft 540, and the support shaft is rotated. Consequently, when the cam gear 320 (as well as the cam shaft 410 and cam lobe 360) is rotating at slow speeds or is at a standstill, the recessed surface 620 faces inward into the concave groove 580 such that the remaining cylindrical portion of the far end 570 of the support shaft 540 protrudes outward from the cam lobe 360 and creates a bump 630 on the cam lobe, as shown in FIG. 9. However, when the cam gear 320 is rotating rapidly, the support shaft 540 is rotated so that the recessed surface 620 faces outward and consequently the bump 630 no longer exists on the cam lobe 360.

The appearance and disappearance of the bump 630 depending upon the speed of rotation of the cam gear 320 changes the effective shape of the cam lobe 360, which affects the operation of the exhaust valve 250 (see FIG. 8). In particular, because of the creation of the bump 630 when the cam gear 320 is rotating slowly or not at all (e.g., when the engine is starting), the exhaust valve 250 tends to open slightly during the compression stroke of the engine 100, allowing some gases to escape the engine during the compression stroke. However, because the bump 630 disappears when the cam gear 320 is rotating at high speeds (e.g., during normal operation of the engine), the exhaust valve 250 no longer opens during the compression stroke of the engine 100, such that engine power is maximized.

In the present embodiment, the cam gear 320 is molded as a single piece (e.g., from plastic) and the cam lobe 360 is attached to the first side 590 of the cam gear 320 or molded as part of the cam gear. In order to keep the arm 510 small in size, and thereby facilitate the manufacture of the arm (e.g., out of powdered metal), the arm is retained in place within the tube 550 by way of retaining components 650 located on the second side 520 of the cam gear 320 rather than the first side 590 of the cam gear. Specifically, to keep the arm 510 axially in place within the tube 550, a retaining disk 610 is positioned onto a pillar 675 extending from the second side 520 of the cam gear 320, until the disk is in contact with a C-shaped ridge or lip 560. An edge 660 of the disk 610 extends over a portion of a second side 680 (opposite the first side 670) of the arc-shaped weight 530 and thereby prevents excessive axial movement of the shaft 540 out of the tube 550. In one embodiment, the disk 610 is a pushnut such as the Palnut® device made by TransTechnology Engineered Components LLC of Brunswick, Ohio, such that the disk has a central orifice 690 with a central portion and slots emanating outward from the central portion.

The C-shaped ridge 560 extends less far from the second side 520 of the cam gear 320 than the pillar 675, but extends far enough away from the second side 520 so that the weight 530 loosely fits (has some clearance) in between the tube 550 and the retaining disk 610 when positioned up against the ridge. Thus the distance between the C-shaped ridge 560 and the second side 520 of the cam gear 320 typically differs from the distance between the second side of the cam gear and the outer edge of the hollow tube 550 by some amount larger than the width of the weight 530. Although in certain embodiments, the outward movement of the weight 530 is limited only by an outer rim 700 of the cam gear 320 (or by the spring 600), in the embodiment of FIG. 9 an edge 710 of the C-shaped ridge 560 operates to limit outward rotation of the weight.

In the present embodiment, the arm 510 is restricted from moving too far towards the cam lobe 360 insofar as the weight 530 cannot move into the tube 550. However, in alternate embodiments, the weight 530 need not be limited in its movement by the tube 550 but rather can rest upon a different portion of the cam gear 320; indeed, in certain alternate embodiments it is a portion of the shaft 540 that rests either against a portion of the cam gear 320 or against a portion of the concave notch 580 (e.g., the end 570 rests against the end of the notch), to limit further movement of the shaft toward the cam lobe 360. Also, in some alternate embodiments, the disk 610 does not directly abut the weight 530, but rather some slack exists such that the shaft and weight can move axially to some extent. Further in some alternate embodiments, if the cam gear 320 and particularly the pillar 675 is made of a molded, thermoplastic material, the retaining disk 610 can be replaced with a simple flat-washer. Upon slipping the washer onto the pillar 675, heat can then be applied to partially melt the portion of the plastic pillar above the washer. In other alternate embodiments, the washer can also be a thermoplastic part that is heated or ultrasonically staked in place with respect to the pillar 675 for retention of the arm 510. Also, if the pillar 675 is metallic or plastic, the pillar can be threaded, and a nut and flat-washer can be used in place of the retaining disk for retention of the arm 510.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. For example, the present invention is applicable generally to the modification of the exterior surface of cam lobes, whether relating to the exhaust valve, intake valve, or other valves of an engine. Accordingly, reference should be made to the following claims, rather than to the foregoing specification, as indicating the scope of the invention.

What is claimed is:

1. An automatic compression release mechanism for implementation in an internal combustion engine, the automatic compression release mechanism comprising:

a cam shaft assembly including a cam gear, a cam lobe positioned along a first side of the cam gear, the cam lobe including a notch;

a hollow tube passing from the first side of the cam gear to a second side of the cam gear and substantially aligned with the notch; and a support extending from the second side of the cam gear proximate the hollow tube;

an arm including a weight and a shaft, wherein a first end of the shaft is fixedly coupled to a near end of the weight and a second end of the shaft includes a recessed portion, wherein the shaft is rotatably positioned within the hollow tube so that the weight is positioned along the second side of the cam gear and the second end of the shaft protrudes out of the hollow tube beyond the first side of the cam gear and into the notch; and a retaining member positioned onto the support so that the weight is positioned in between the retaining member and the hollow tube and retained with respect to the cam gear.

2. The automatic compression release mechanism of claim 1, wherein the support includes a pillar, and the retaining member is a disk having a central orifice, the retaining member being positioned onto the pillar by positioning the pillar through the central orifice.

3. The automatic compression release mechanism of claim 2, wherein the weight is located in between a lip of the disk and the hollow tube.

4. The automatic compression release mechanism of claim 3, wherein the disk is at least one of metallic and plastic, and wherein the disk is a pushnut that has a central orifice that includes slots that project away from a central portion of the central orifice.

5. The automatic compression release mechanism of claim 2, wherein the support further includes a C-shaped ridge extending around the pillar, and wherein the pillar extends farther away from the second side of the cam gear than the C-shaped ridge.

6. The automatic compression release mechanism of claim 5, wherein the disk is positioned onto the support so that the pillar extends through the central orifice and so that the disk rests upon the C-shaped ridge.

7. The automatic compression release mechanism of claim 6, wherein the C-shaped ridge extends a sufficient distance away from the second side of the cam gear so that, when the disk rests upon the C-shaped ridge, the lip of the disk is at a proper position for retaining the weight against the hollow tube.

8. The automatic compression release mechanism of claim 2, wherein the pillar is made from plastic, and the retaining member is a flat washer.

9. The automatic compression release mechanism of claim 8, wherein the retaining member is fixed in its position with respect to the pillar by heating the pillar so that a portion of the pillar melts against the flat washer.

10. The automatic compression release mechanism of claim 2, wherein the retaining member is made from plastic and fixed in its position with respect to the pillar by at least one of heating and ultrasonically staking the retaining member with respect to the pillar.

11. The automatic compression release mechanism of claim 2, wherein the pillar is made from one of metal and plastic, and is threaded, and the retaining member includes a nut and a flat washer, where the flat washer is positioned to abut the weight and the nut is threaded onto the pillar to prevent the flat washer from moving off of the pillar.

12. The automatic compression release mechanism of claim 1, further comprising a spring coupled to the weight.

13. The automatic compression release mechanism of claim 12, wherein the cam shaft assembly further includes a central shaft that protrudes out of the second side of the cam gear, wherein the weight is biased by the spring toward the central shaft.

14. The automatic compression release mechanism of claim 13, wherein the arm rotates about the shaft increasingly far away from the central shaft as the cam shaft assembly rotates at increasingly high speeds.

15. The automatic compression release mechanism of claim 14, wherein at low speeds of the cam shaft assembly the arm is rotated so that a portion of the second end of the shaft protrudes out of the notch forming a bump along an exterior surface of the cam lobe, and wherein at high speeds of the cam shaft assembly the arm is rotated so that the recessed portion of the second end of the shaft no longer protrudes out of the notch.

16. The automatic compression release mechanism of claim 15, wherein at high speeds of the cam shaft assembly the weight is limited from rotating farther outward away from the cam shaft tube by at least one of an outer rim of the cam gear and an edge of a C-shaped ridge included as part of the support, and wherein the weight is arc-shaped.

17. An automatic compression release mechanism comprising:

a cam lobe;

a cam gear having a first side and a second side, the cam lobe abutting the first side;

an arm including a weighted portion positioned proximate the second side of the cam gear and a shaft fixedly coupled to the weighted portion and extending through a tube from the second side of the cam gear to and beyond the first side of the cam gear and into a notch within the cam lobe; and means for retaining the arm in a substantially constant position with respect to an axis of the tube.

18. A method of assembling an automatic compression release mechanism on an internal combustion engine, the method comprising:

providing a camshaft assembly including a cam lobe and a cam gear having a first side and a second side, wherein the first side of the cam gear is adjacent to the cam lobe, wherein the cam lobe includes a notch along its exterior surface, wherein the cam gear includes a hollow tube that extends through the cam gear and is aligned with the notch along the first side of the cam gear, and wherein the cam gear further includes a pillar protruding from the second side;

providing an arm having a weight with a first side and a second side and a shaft having a first end and a second end, wherein the first end of the shaft is attached to the weight, and wherein the second end of the shaft includes a recessed portion;

inserting the shaft of the arm through the hollow tube so that the second end of the shaft including the recessed portion is positioned at least partly within the notch, and so that the first side of the weight is proximate the hollow tube; and coupling a retaining member to the pillar so that at least a portion of the retaining member extends over the second side of the weight and prevents excessive movement of the shaft out of the hollow tube and excessive movement of the weight away from the second side of the cam gear.

19. The method of claim 18, wherein the cam gear further includes a C-shaped ridge extending from the second side of the cam gear and surrounding the pillar, wherein the C-shaped ridge extends less far from the second side of the cam gear than the pillar, wherein the retaining member is a disk with a central orifice, and wherein the retaining member is coupled to the pillar by slipping the central orifice over the pillar and pushing the retaining member down onto the pillar until the disk abuts the C-shaped ridge.

20. The method of claim 18, wherein the coupling of the retaining member includes at least one of:

positioning the retaining member onto the pillar and applying heat to the pillar and the retaining member, wherein the pillar is made from a plastic and the retaining member is metallic;

positioning the retaining member onto the pillar and applying ultrasonic vibration to the pillar and the retaining member; and positioning a washer onto the pillar and screwing a nut onto the pillar over the washer to retain the washer, the washer and nut together forming the retaining member.

* * * * *